US009378682B2

(12) United States Patent
Lim et al.

(10) Patent No.: US 9,378,682 B2
(45) Date of Patent: Jun. 28, 2016

(54) ORGANIC LIGHT EMITTING DIODE DISPLAY HAVING FUNCTION FOR CONTROLLING PEAK LUMINANCE USING WEIGHTED AVERAGE PICTURE LEVEL AND METHOD FOR DRIVING THE SAME

(71) Applicant: LG DISPLAY CO., LTD., Seoul (KR)

(72) Inventors: Kyongho Lim, Paju-si (KR); Sunhee Park, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 180 days.

(21) Appl. No.: 14/100,711

(22) Filed: Dec. 9, 2013

(65) Prior Publication Data

US 2014/0320546 A1 Oct. 30, 2014

(30) Foreign Application Priority Data

Apr. 30, 2013 (KR) ..... 10-2013-0047894

(51) Int. Cl.
*G09G 3/30* (2006.01)
*G09G 3/32* (2016.01)

(52) U.S. Cl.
CPC ..... *G09G 3/3291* (2013.01); *G09G 2320/0673* (2013.01); *G09G 2330/021* (2013.01); *G09G 2360/16* (2013.01)

(58) Field of Classification Search
CPC ..... G09G 3/3291; G09G 2320/0673; G09G 2360/16; G09G 2330/021
USPC ..... 345/690, 77
See application file for complete search history.

(56) References Cited

U.S. PATENT DOCUMENTS 8,330,754 B2 * 12/2012 Byun ..... G09G 3/3208 345/211
2006/0107223 A1 * 5/2006 Mirtich ..... G06F 3/0481 715/764
2014/0152704 A1 * 6/2014 Jeong ..... G09G 3/3233 345/690
2014/0285726 A1 * 9/2014 Allen ..... H04N 9/3155 348/759

FOREIGN PATENT DOCUMENTS

KR 20100095093 A 8/2010

* cited by examiner

*Primary Examiner* — Kwang-Su Yang
(74) *Attorney, Agent, or Firm* — Dentons US LLP

(57) ABSTRACT

Provided is an organic light emitting diode display including a display panel having data lines, gate lines, and pixels disposed in a matrix form in a crossing region of the data lines and the gate lines, a gamma reference voltage adjustment unit that calculates a weighted average picture level of digital video data, adjusts gamma reference voltages so that peak luminance of the display panel is reduced as the weighted average picture level is increased, and outputs the adjusted gamma reference voltages, a data driving circuit converting the digital video data into analog data voltages by using the gamma reference voltages, and supplying the data voltages to the data lines, and a gate driving circuit sequentially outputting gate pulses to the gate lines.

10 Claims, 9 Drawing Sheets

ORGANIC LIGHT EMITTING DIODE DISPLAY HAVING FUNCTION FOR CONTROLLING PEAK LUMINANCE USING WEIGHTED AVERAGE PICTURE LEVEL AND METHOD FOR DRIVING THE SAME

CROSS-REFERENCE TO RELATED APPLICATIONS

The present invention claims the benefit of Korean Patent Application No. 10-2013-0047894, filed on Apr. 30, 2013, which is hereby incorporated by reference for all purposes as if fully set forth herein.

BACKGROUND OF THE INVENTION

1. Field of the Invention

The present invention relates to an organic light emitting diode display and a method for driving the same.

2. Discussion of the Related Art

In accordance with development of information-oriented society, various types of demands for a display device displaying an image are growing. Accordingly, recently, various flat panel displays such as a liquid crystal display (LCD), a plasma display panel (PDP), and an organic light emitting diode (OLED) display have been used. Among the flat panel displays, the organic light emitting diode display is characterized in that driving is feasible at low voltages, a thickness is small, a viewing angle is excellent, and a response speed is high. Among the organic light emitting diode displays, an active matrix type organic light emitting diode display where a plurality of pixels are positioned in a matrix form to display the image is extensively used.

The active matrix type organic light emitting diode display is provided with a display panel including a plurality of pixels disposed in a matrix form. Each pixel includes a scan TFT (thin film transistor) responding to a gate signal of a gate line to supply a data voltage of a data line, and a driving TFT adjusting an amount of a current supplied to an organic light emitting diode (OLED) according to the data voltage supplied to a gate electrode. As a grayscale to be displayed by a pixel is increased, the current flowing through the organic light emitting diode of the pixel is increased.

Meanwhile, as an average picture level full of the image displayed by the organic light emitting diode display is increased, the number of pixels displaying a white grayscale is increased. The white grayscale means 192 to 255 grayscales where most significant two bits have a value of "11" when input digital video data are 8 bits. The current flowing through the organic light emitting diode of the pixel displaying the white grayscale is larger than the current flowing through the organic light emitting diode of the pixel displaying a gray grayscale and a black grayscale. Accordingly, as the number of pixels displaying the white grayscale is increased, power consumption of the organic light emitting diode display is increased. Therefore, currently, there is a demand for a way to reduce power consumption of the organic light emitting diode display.

SUMMARY OF THE INVENTION

The present invention has been made in an effort to provide an organic light emitting diode display having reduced power consumption and a method for driving the same.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Figure 1:
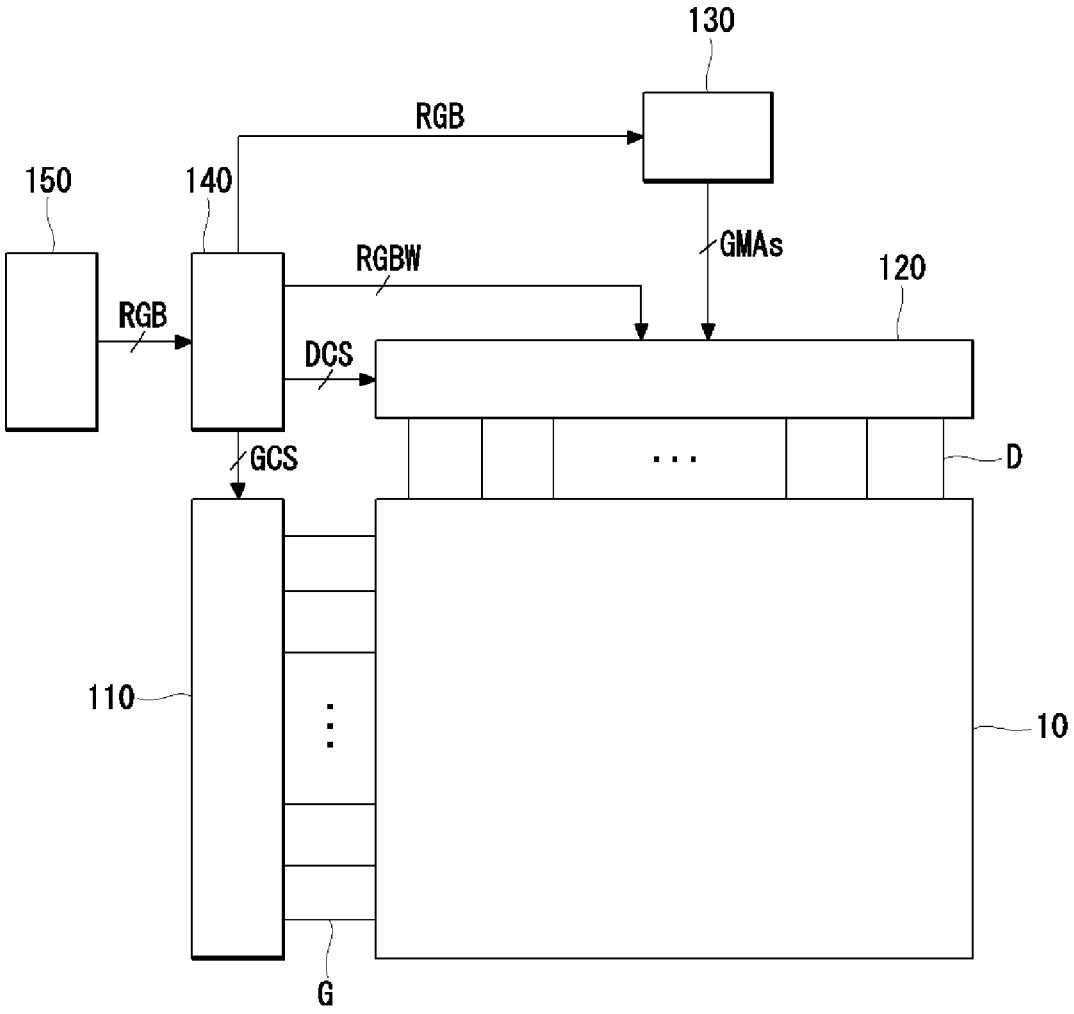
FIG. 1 is a block diagram schematically showing an organic light emitting diode display according to an exemplary embodiment of the present invention.

FIG. 1 is a block diagram schematically showing an organic light emitting diode display according to an exemplary embodiment of the present invention. Referring to FIG. 1, the organic light emitting diode display according to the exemplary embodiment of the present invention includes a display panel 10, a gate driving circuit 110, a data driving circuit 120, a gamma reference voltage adjustment unit 130, a controller 140, and a host system 150.

Figure 2:
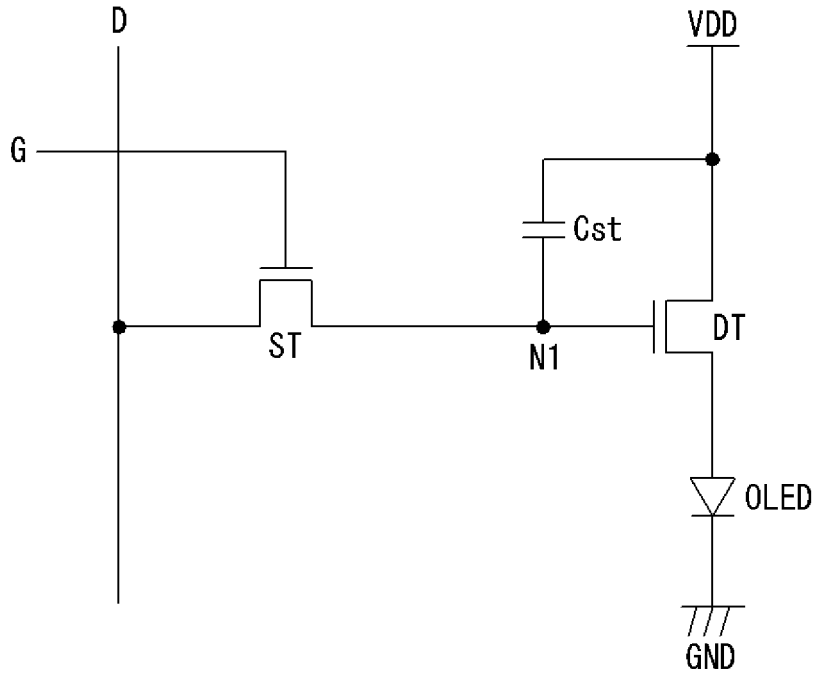
FIG. 2 is an illustrative view showing a circuit constitution of a pixel of a display panel of FIG. 1.

Data lines D and gate lines G are formed to cross each other in the display panel 10. A pixel array where pixels are disposed in a matrix form is formed in a crossing region of the data lines D and the gate lines G. Each pixel of the display panel 10 includes at least one switching TFT (thin film transistor) ST, a driving TFT DT, an organic light emitting diode (OLED) element, and at least one capacitor Cst like FIG. 2. Each pixel controls a current flowing through the organic light emitting diode (OLED) element by using the switching TFT ST and the driving TFT DT to display an image. Specifically, the switching TFT ST responds to a gate pulse of the gate line G to supply a data voltage of the data line D to a first node N1. The driving TFT DT may adjust an amount of the current flowing through the organic light emitting diode OLED from a high potential voltage VDD according to the voltage of the first node N1. Finally, a light emission quantity of the organic light emitting diode OLED may be adjusted by adjusting the data voltage supplied to the first node N1. The display panel 10 may display the image in a form of bottom emission and top emission according to a pixel structure.

The gate driving circuit 110 includes a plurality of gate drive ICs (integrated circuit). The gate drive ICs control at least one switching TFT of each pixel by using at least one gate pulse. The gate drive ICs sequentially supply the gate pulses to the gate lines G of the display panel 10. The gate drive ICs may be mounted on a gate TCP (tape carrier package). The gate TCP may be bonded to the display panel 10 by a TAB (tape automated bonding) process. Alternatively, the gate drive ICs may be directly formed together with the pixel array by a GIP (gate in panel) process.

The data driving circuit 120 includes a plurality of source drive ICs. The source drive ICs receive digital video data RGB from the controller 140. The source drive ICs receive gamma reference voltages GMAs from the gamma reference voltage adjustment unit 130, and calculate gamma compensation voltages from the gamma reference voltages GMAs by using a voltage divider circuit. The source drive ICs convert the digital video data RGB into analogue data voltages by using the gamma compensation voltages, synchronize the data voltages with the gate pulse, and supply the data voltages to the data lines D of the display panel 10. The source drive ICs may be mounted on a source TCP. The source TCP may be bonded to the display panel 10 and a source PCB (printed circuit board) by a TAB process. Alternatively, the source drive ICs may be directly attached to the display panel 10 by a COG (chip on glass) process.

The gamma reference voltage adjustment unit 130 receives the digital video data RGB from the controller 140, and calculates a weighted average picture level of the digital video data RGB. The gamma reference voltage adjustment unit 130 adjusts the gamma reference voltages so that peak luminance of the display panel is reduced as the weighted average picture level is increased, and outputs the adjusted gamma reference voltages. A detailed description of the gamma reference voltage adjustment unit 130 will be given below with reference to FIG. 2.

The controller 140 receives the digital video data RGB and a timing signal from the host system 150. The timing signal may include a vertical synchronization signal, a horizontal synchronization signal, a data enable signal, and a dot clock.

The controller 140 may be provided with a digital data conversion unit converting the digital video data RGB including red, green, and blue data to generate digital conversion data RGBW including red, green, blue, and white data. The digital data conversion unit may be embodied by any known constitution as long as the red, green, and blue data are converted into the red, green, blue, and white data in the constitution. Meanwhile, a description of embodiment of each pixel of the display panel, which includes a red subpixel, a green subpixel, a blue subpixel, and a white subpixel, is mainly given in the exemplary embodiment of the present invention. Accordingly, the digital data conversion unit converting the digital video data RGB into the digital conversion data RGBW is essentially required to drive the display panel according to the exemplary embodiment of the present invention. However, it is important to note that the subpixels of the pixels of the display panel are not limited thereto. That is, when each pixel of the display panel includes the red subpixel, the green subpixel, and the blue subpixel, the digital data conversion unit converting the digital video data RGB into the digital conversion data RGBW is not required. Accordingly, the digital data conversion unit may be omitted.

The controller 140 generates a gate timing control signal GCS controlling operation timing of the gate driving circuit 110 and a data timing control signal DCS controlling operation timing of the data driving circuit 120 based on the timing signal. The controller 140 outputs the gate timing control signal GCS to the gate driving circuit 110. The controller 140 outputs the digital conversion data RGBW and the data timing control signal DCS to the data driving circuit 120. Further, the controller 140 outputs the digital video data RGB to the gamma reference voltage adjustment unit 130.

The host system 150 may include a system on chip including a scaler built therein to convert the digital video data RGB inputted from external video source equipment into a data format having resolution suitable to be displayed on the display panel 10. The host system 150 supplies the digital video data RGB and the timing signals to the controller 140 through an interface such as a LVDS (low voltage differential signaling) interface and a TMDS (transition minimized differential signaling) interface.

Figure 3:
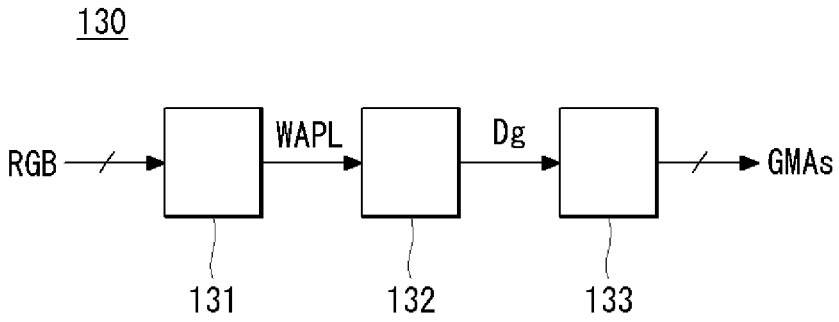
FIG. 3 is a block diagram showing in detail a gamma reference voltage adjustment unit of FIG. 1.
Figure 4:
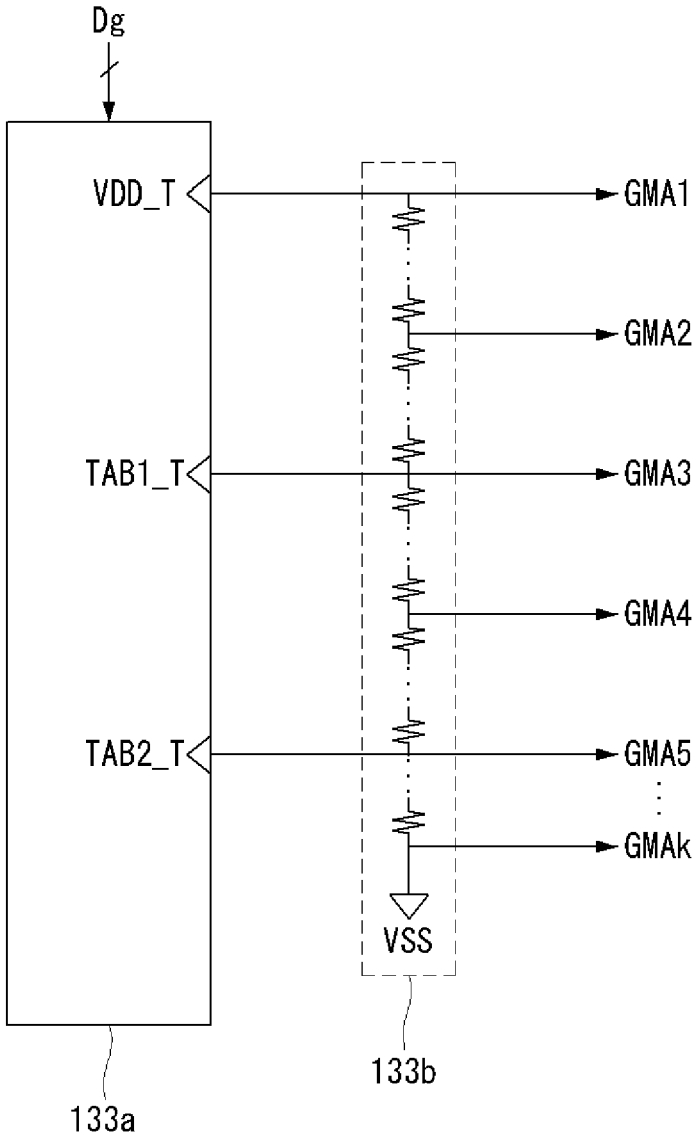
FIG. 4 is an illustrative view showing in detail a gamma reference voltage output circuit of FIG. 3.
Figure 5:
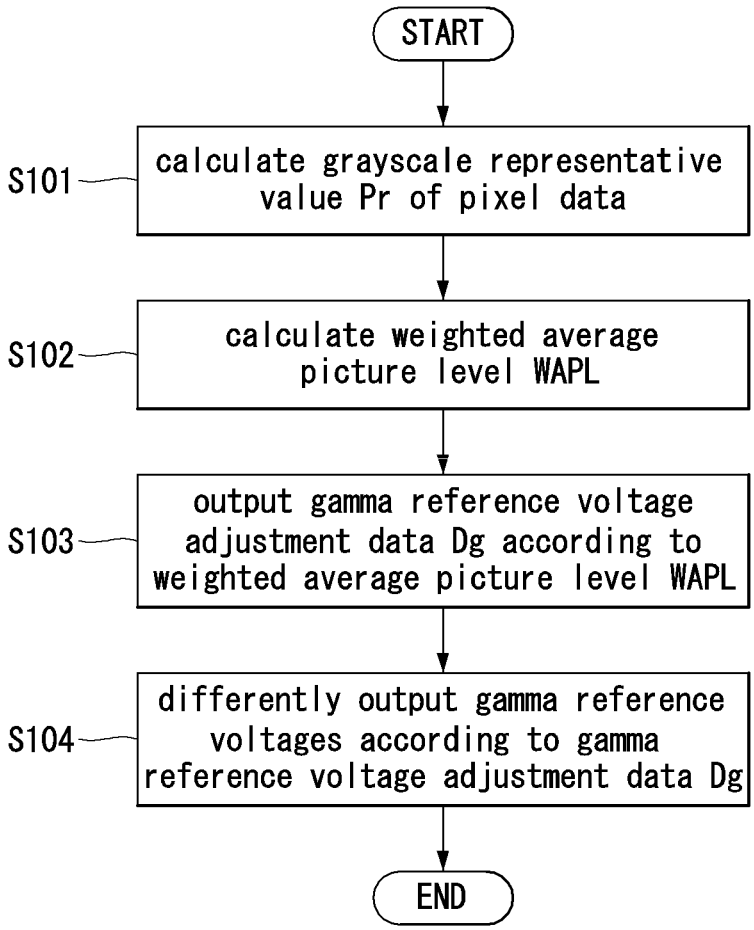
FIG. 5 is a flowchart showing a method for outputting a gamma reference voltage of the gamma reference voltage adjustment unit of FIG. 3.

FIG. 3 is a block diagram showing in detail the gamma reference voltage adjustment unit of FIG. 1. FIG. 4 is an illustrative view showing in detail a gamma reference voltage output circuit of FIG. 3. FIG. 5 is a flowchart showing a method for controlling the gamma reference voltage of the gamma reference voltage adjustment unit of FIG. 3. Referring to FIG. 3, the gamma reference voltage adjustment unit 130 includes a weighted average picture level calculator 131, a gamma reference voltage adjustment data output unit 132, and a gamma reference voltage output circuit 133. Hereinafter, the method for controlling the gamma reference voltage of the gamma reference voltage adjustment unit will be described in detail with reference to FIGS. 3 to 5.

The weighted average picture level calculator 131 receives the digital video data RGB from the controller 140, and calculates a weighted average picture level WAPL from the digital video data RGB. Particularly, the weighted average picture level calculator 131 calculates the weighted average picture level WAPL of an N frame period from the digital video data RGB of the N (N is a positive integer) frame period. The digital video data RGB of the N frame period includes r×s pixel data (r is the number of the pixels present on any one horizontal line and s is the number of the pixels present on any one vertical line). Each of the pixel data may include the red data R, the green data G, and the blue data B.

The weighted average picture level calculator 131 may calculate a grayscale representative value Pr of each of the pixel data like Equation 1.

$$Pr=\mathrm{Max}(R,G,B) \quad \text{[Equation 1]}$$

In Equation 1, Pr means the grayscale representative value of the pixel data, R means the red data of the pixel data, G means the green data of the pixel data, and B means the blue data of the pixel data. The weighted average picture level calculator 131 may calculate a maximum value of the red data R, the green data G, and the blue data B of the pixel data as the grayscale representative value Pr of the pixel data like Equation 1. Meanwhile, the grayscale representative value Pr of the pixel may be calculated by a method other than Equation 1. For example, the grayscale representative value Pr may be calculated as a luminance value Y of the pixel data S101.

The weighted average picture level calculator 131 calculates the grayscale representative value of each of the pixel data, and then calculates the weighted average picture level WAPL by using the grayscale representative value like Equation 2.

$$WAPL = \frac{\sum (Pr^2/T)}{\sum (Pr/T)} \quad \text{[Equation 2]}$$

In Equation 2, WAPL means the weighted average picture level, Pr means the grayscale representative value, and T means a peak white grayscale. When input digital video data are 8 bits, the peak white grayscale is 255. That is, according to Equation 2, the weighted average picture level calculator 131 calculates a sum of values obtained by dividing a square of the grayscale representative value Pr by the peak white grayscale T as a first value (numerator of Equation 2), and calculates a sum of values obtained by dividing the grayscale representative value Pr by the peak white grayscale T as a second value (denominator of Equation 2). Then, the weighted average picture level calculator 131 calculates a value obtained by dividing the first value (numerator of Equation 2) by the second value (denominator of Equation 2) as the weighted average picture level WAPL. The weighted average picture level calculator 131 outputs the weighted average picture level WAPL to the gamma reference voltage adjustment data output unit 132. Particularly, the weighted average picture level calculator 131 may calculate the weighted average picture level WAPL during every 1 frame period S102.

The gamma reference voltage adjustment data output unit 132 receives the weighted average picture level WAPL from the weighted average picture level calculator 131. The gamma reference voltage adjustment data output unit 132 outputs gamma reference voltage adjustment data Dg according to the weighted average picture level WAPL. The gamma reference voltage adjustment data Dg include high potential voltage data indicating the high potential voltage VDD to be supplied to a high potential voltage terminal VDD_T, and tap voltage data indicating tap voltages to be supplied to tap voltage terminals TAB1_T to TABk_T.

Specifically, the gamma reference voltage adjustment data output unit 132 may include a look-up table storing the gamma reference voltage adjustment data Dg. In this case, the gamma reference voltage adjustment data output unit 132 may input the weighted average picture level WAPL to an input address of the look-up table, and output the gamma reference voltage adjustment data Dg stored in the corresponding input address. The gamma reference voltage adjustment data Dg may be adjusted so that peak luminance of the display panel is reduced as the weighted average picture level WAPL is increased. The gamma reference voltage adjustment data Dg may be determined in advance through a prior experiment. A method for calculating the gamma reference voltage adjustment data Dg will be described in detail below with reference to FIGS. 6 to 10.

The gamma reference voltage output circuit 133 receives the gamma reference voltage adjustment data Dg from the gamma reference voltage adjustment data output unit 132. Referring to FIG. 4, the gamma reference voltage output circuit 133 includes a digital to analogue converter 133*a* and a voltage divider circuit 133*b*. The gamma reference voltage adjustment data Dg include the high potential voltage data indicating the high potential voltage VDD to be supplied to the high potential voltage terminal VDD_T, and the tap voltage data indicating the tap voltages to be supplied to the tap voltage terminals TAB1_T to TAB2_T. The digital to analogue converter 133*a* converts the high potential voltage data as digital data into the high potential voltage as analogue voltage. The digital to analogue converter 133*a* converts the tap voltage data as the digital data into a plurality of tap voltages as the analogue voltage. The digital to analogue converter 133*a* supplies the high potential voltage and a plurality of tap voltages to the voltage divider circuit 133*b*. The voltage divider circuit 133*b* divides the high potential voltage, the tap voltages, and the low potential voltage VSS, and outputs k (k is a positive integer) gamma reference voltages GMA1 to GMAk. Meanwhile, in FIG. 4, for understanding and ease of description, it should be noted that only first and second tap voltage terminals TAB1_T and TAB2_T are shown. The number of the tap voltage terminals and the tap voltages may be determined in advance through a prior experiment S104.

As described above, in the exemplary embodiment of the present invention, the gamma reference voltages GMA1 to GMAk may be outputted by calculating the gamma reference voltage adjustment data Dg including the high potential voltage data and the tap voltage data based on the weighted average picture level WAPL, converting the high potential voltage data and the tap voltage data as the digital data into the high potential voltage and the tap voltages as the analogue voltage, and supplying the high potential voltage and the tap voltages to the voltage divider circuit 133*b*. That is, the exemplary embodiment of the present invention may adjust the gamma reference voltages GMA1 to GMAk according to the weighted average picture level WAPL. Further, the voltage divider circuit of the data driving circuit 120 calculates the gamma compensation voltages from the gamma reference voltages GMA1 to GMAk. The data voltages supplied to the pixels are calculated by using the gamma compensation voltages. Accordingly, when the gamma reference voltages GMA1 to GMAk are adjusted, the data voltages may be adjusted. Therefore, a light emission quantity of the organic light emitting diode (OLED) element of each of the pixels of the display panel may be controlled. That is, peak luminance of each of the pixels of the display panel may be controlled. Ultimately, the exemplary embodiment of the present invention may control peak luminance of the pixels of the display panel according to the weighted average picture level WAPL.

Hereinafter, referring to FIGS. 6 and 7, the method for calculating the gamma reference voltage adjustment data Dg stored in the look-up table of the gamma reference voltage adjustment data output unit 132 will be described by examining in detail a method for controlling peak luminance of the display panel according to the weighted average picture level WAPL in the exemplary embodiment of the present invention.

Figure 6:
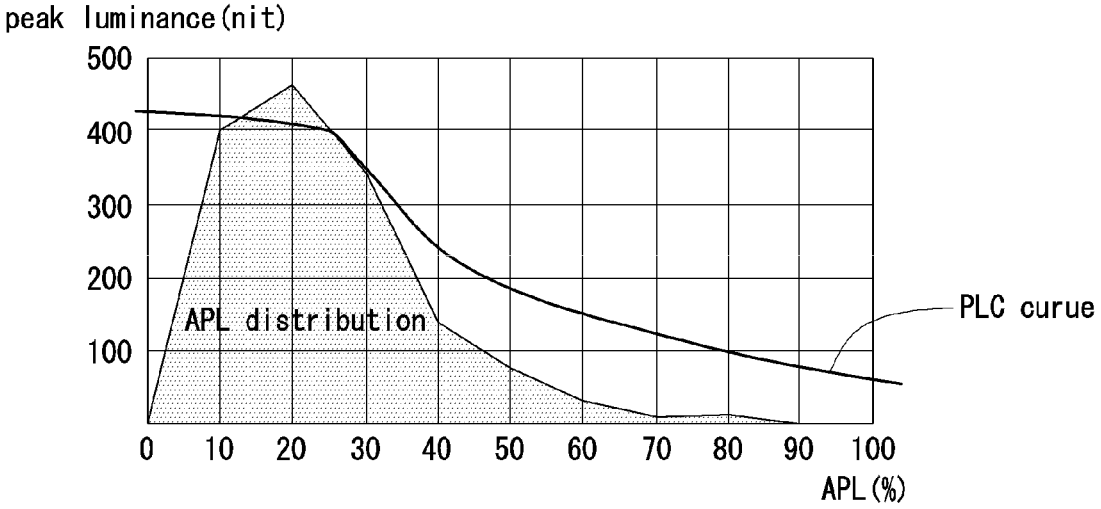
FIG. 6 is a graph showing an average picture level distribution and a change in peak luminance according to the average picture level as a comparative example.

FIG. 6 is a graph showing an average picture level histogram and a change in peak luminance according to the average picture level as a comparative example. FIG. 7 is a graph showing a weighted average picture level histogram and a change in peak luminance according to the weighted average picture level as the exemplary embodiment of the present invention. Peak luminance of the display panel means luminance when the pixels of the display panel display the peak white grayscale. When input digital video data are 8 bits, the peak white grayscale is 255.

Figure 7:
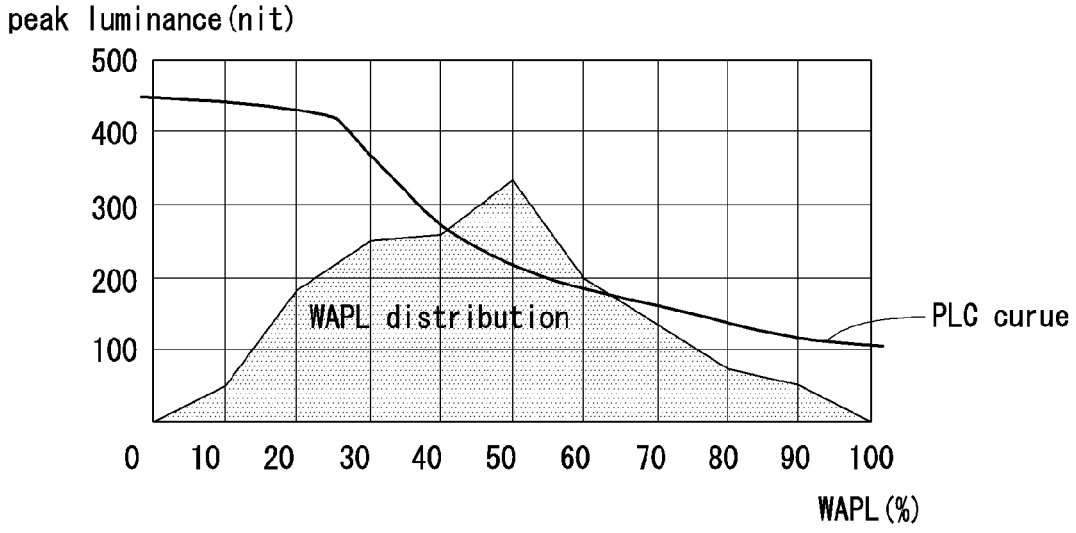
FIG. 7 is a graph showing a weighted average picture level distribution and a change in peak luminance according to a weighted average picture level as an exemplary embodiment of the present invention.

FIGS. 6 and 7 show peak luminance control curves (PLC curve). The peak luminance control curve (PLC curve) is a curve showing peak luminance according to the average picture level (APL) or the weighted average picture level WAPL. For reference, the average picture level APL may be calculated like Equation 3. In Equation 3, APL means the average picture level, Pr means the grayscale representative value, and T means the peak white grayscale. When input digital video data are 8 bits, the peak white grayscale is 255.

$$APL(\%) = \frac{\sum (Pr/T)}{r \times s} \times 100 \quad \text{[Equation 3]}$$

According to the peak luminance control curve (PLC curve), the average picture level APL or the weighted average picture level WAPL is in approximately inverse proportion to the peak luminance. For example, as shown in FIGS. 6 and 7, when the average picture level APL or the weighted average picture level WAPL is 25%, the peak luminance may be controlled to 400 nit. When the average picture level APL or the weighted average picture level WAPL is 100%, the peak luminance may be controlled to 100 nit. This is constituted to reduce power consumption because the number of the pixels displaying the white grayscale is increased as the average picture level APL or the weighted average picture level WAPL is increased to increase power consumption. The white grayscale means 192 to 255 grayscales where most significant two bits have a value of "11" when the input digital video data are 8 bits.

FIGS. 6 and 7 show the histogram of the average picture level calculated from an international standard IEC62087 image and the histogram of the weighted average picture level calculated from the IEC62087 image. It can be seen that the histogram of the weighted average picture level calculated from the IEC62087 image is shifted to the right as compared to the histogram of the average picture level calculated from the IEC62087 image. That is, the average picture level APL calculated from the IEC62087 image is mainly distributed within 10 to 40%. On the other hand, the weighted average picture level WAPL calculated from the IEC62087 image is symmetrically distributed to both sides based on 50%. Accordingly, when the peak luminance is calculated according to the weighted average picture level WAPL calculated from the IEC62087 image, the peak luminance of the display panel may be low as compared to the case where the peak luminance is calculated according to the average picture level APL calculated from the IEC62087 image. That is, in the exemplary embodiment of the present invention, the peak luminance of the display panel may be low as compared to the comparative example. Accordingly, power consumption may be reduced.

Figure 8:
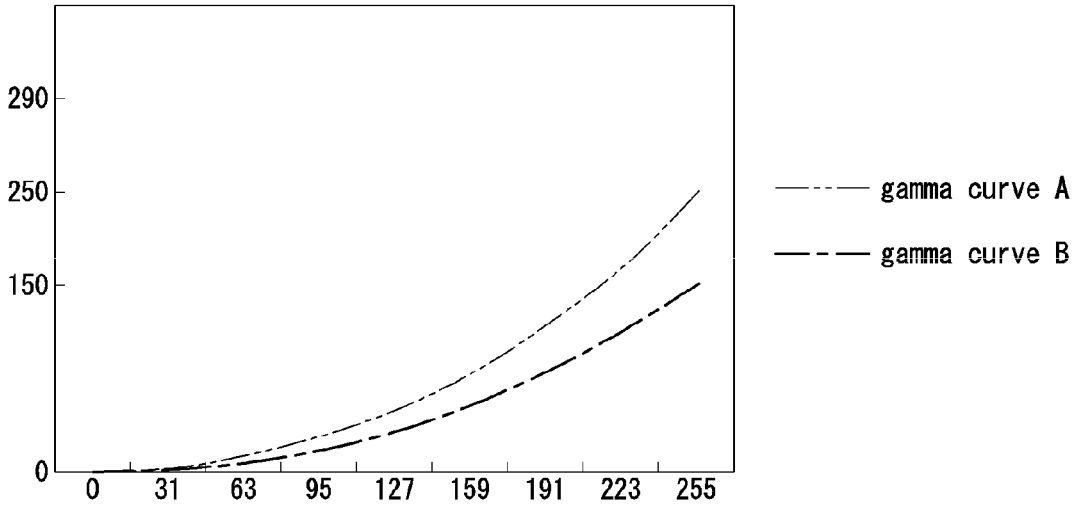
FIG. 8 is an illustrative view showing gamma curves when the weighted average picture level of FIG. 7 is 40% and 60%.

FIG. 8 is an illustrative view showing gamma curves when the weighted average picture level of FIG. 7 is 40% and 60%. Referring to FIG. 8, gamma curve A is a gamma curve for controlling the peak luminance to about 250 nit when the weighted average picture level WAPL is 40%. Gamma curve B is a gamma curve for controlling the peak luminance to about 150 nit when the weighted average picture level WAPL is 60%.

An x axis of the gamma curve indicates a grayscale value, and a y axis indicates the luminance. That is, the gamma curve is a curve showing the luminance according to the grayscale, and has an exponential function form where the luminance is increased as the grayscale is increased. The peak luminance when the weighted average picture level WAPL is 40% is higher than the peak luminance when the weighted average picture level WAPL is 60%. Accordingly, the luminance in the 255 grayscale of gamma curve A is higher than the luminance in the 255 grayscale of gamma curve B. When input digital video data are 8 bits, the peak white grayscale is the 255 grayscale.

Finally, the luminance of the peak white grayscale is controlled to be low as the weighted average picture level WAPL is increased. Further, the luminances of all grayscales as well as the peak white grayscale are controlled to be low. Accordingly, in the exemplary embodiment of the present invention, the data voltages supplied to the pixels of the display panel are controlled so that the light emission quantity of the organic light emitting diode (OLED) element of the pixel is reduced as the weighted average picture level WAPL is increased. This is feasible by adjusting the gamma reference voltages GMAs outputted from the gamma reference voltage adjustment unit 130 as described above. That is, the gamma reference voltage adjustment unit 130 according to the exemplary embodiment of the present invention adjusts the gamma reference voltages by using the gamma reference voltage adjustment data Dg designed in advance so that the gamma reference voltages are reduced as the weighted average picture level WAPL is increased. Accordingly, the light emission quantity of the organic light emitting diode element of the pixels of the display panel 10 may be reduced as the weighted average picture level WAPL is increased. Therefore, in the exemplary embodiment of the present invention, the data voltages supplied to the pixels of the display panel 10 may be adjusted by adjusting the gamma reference voltages GMAs. Accordingly, in the present invention, the light emission quantity of the organic light emitting diode (OLED) element of the pixels may be adjusted, and thus the peak luminance of the display panel may be controlled.

As described above, in the exemplary embodiment of the present invention, the gamma reference voltages are adjusted to control the peak luminance according to the weighted average picture level WAPL. The gamma reference voltage adjustment data Dg stored in the look-up table are used to adjust the gamma reference voltages. Particularly, in the exemplary embodiment of the present invention, as described above with reference to FIGS. 6 to 8, the high potential voltage and the tap voltages of the gamma reference voltage output circuit 133 may be calculated according to the weighted average picture level WAPL by using the peak luminance control curve (PLC curve) through a prior experiment. Therefore, in the exemplary embodiment of the present invention, the gamma reference voltage adjustment data Dg including the high potential voltage data and the tap voltage data may be calculated, and the look-up table storing the gamma reference voltage adjustment data Dg may be designed.

Figure 9:
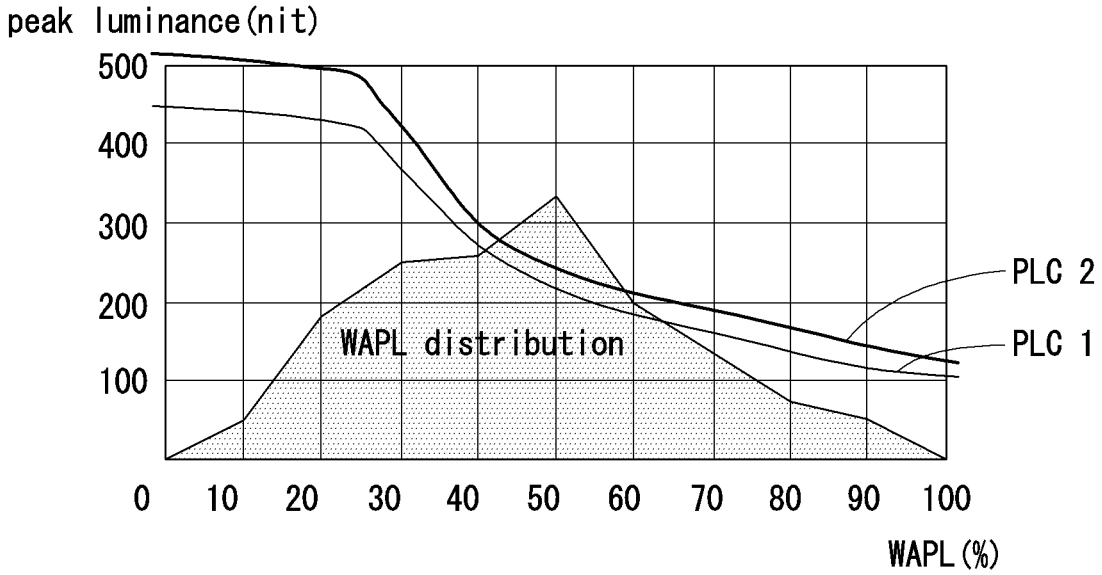
FIG. 9 is a graph showing a weighted average picture level distribution and a change in peak luminance according to a weighted average picture level as another exemplary embodiment of the present invention.

FIG. 9 is a graph showing a weighted average picture level distribution and a change in peak luminance according to a weighted average picture level as another exemplary embodiment of the present invention. FIG. 9 show first and second peak luminance control curves PLC1 and PLC2. The first and second peak luminance control curves PLC1 and PLC2 are curves showing peak luminance according to the weighted average picture level WAPL. According to the first and second peak luminance control curves PLC1 and PLC2, the weighted average picture level WAPL is in approximately inverse proportion to the peak luminance. Further, FIG. 9 shows a histogram of the weighted average picture level WAPL calculated from an international standard IEC62087 image.

Referring to FIG. 9, in the first peak luminance control curve PLC1, the peak luminance is about 250 nit when the weighted average picture level WAPL is 40%. In the second peak luminance control curve PLC2, the peak luminance is about 290 nit when the weighted average picture level WAPL is 40%. Further, in the first peak luminance control curve PLC1, the peak luminance is about 150 nit when the weighted average picture level WAPL is 60%. In the second peak luminance control curve PLC2, the peak luminance is about 190 nit when the weighted average picture level WAPL is 60%. That is, even at the same weighted average picture level WAPL, the peak luminance in the second peak luminance control curve PLC2 is higher than the peak luminance in the first peak luminance control curve PLC1. In the exemplary embodiment of the present invention, a picture quality may be improved by upwardly adjusting the peak luminance control curve (PLC1→PLC2) for a reduction in power consumption.

Figure 10:
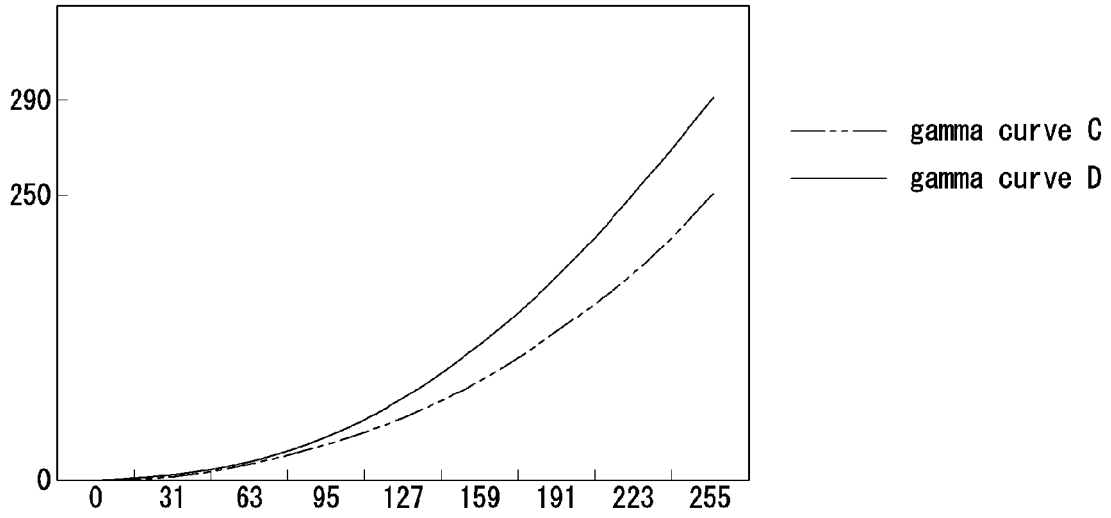
FIG. 10 is an illustrative view showing gamma curves when the weighted average picture level is 40% in a first peak luminance control curve and when the weighted average picture level is 40% in a second peak luminance control curve in FIG. 9.

FIG. 10 is an illustrative view showing gamma curves when the weighted average picture level is 40% in the first peak luminance control curve and when the weighted average picture level is 40% in the second peak luminance control curve in FIG. 9.

Referring to FIG. 10, gamma curve C is a gamma curve for controlling the peak luminance to about 250 nit when the weighted average picture level WAPL is 40% in the first peak luminance control curve PLC1. Gamma curve D is a gamma curve for controlling the peak luminance to about 290 nit when the weighted average picture level WAPL is 40% in the second peak luminance control curve PLC2.

The gamma curve is a curve showing the luminance according to a grayscale, and has an exponential function form where the luminance is increased as the grayscale is increased. The peak luminance when the weighted average picture level WAPL is 40% in the first peak luminance control curve PLC1 is lower than the peak luminance when the weighted average picture level WAPL is 40% in the second peak luminance control curve PLC2. Accordingly, the luminance in the 255 grayscale of gamma curve C is lower than the luminance in the 255 grayscale of gamma curve D. When input digital video data are 8 bits, a peak white grayscale is the 255 grayscale. Further, a change width of the luminance of gamma curve D in a range of the 255 grayscale is larger than the change width of the luminance of gamma curve C. Accordingly, it can be considered that a grayscale classification ability of gamma curve D is higher than the grayscale classification ability of gamma curve C.

Finally, the luminance of the peak white grayscale is controlled to be low as the weighted average picture level WAPL is increased. Further, the luminances of all grayscales as well as the peak white grayscale are controlled to be low. Accordingly, in the exemplary embodiment of the present invention, data voltages supplied to pixels of a display panel are controlled so that a light emission quantity of an organic light emitting diode (OLED) element of the pixel is reduced as the weighted average picture level WAPL is increased. This is feasible by adjusting gamma reference voltages GMAs outputted from a gamma reference voltage adjustment unit 130 as described above. That is, the gamma reference voltage adjustment unit 130 according to the exemplary embodiment of the present invention adjusts the gamma reference voltages by using gamma reference voltage adjustment data Dg designed in advance so that the gamma reference voltages are reduced as the weighted average picture level WAPL is increased. Accordingly, the light emission quantity of the organic light emitting diode element of the pixels of the display panel 10 may be reduced as the weighted average picture level WAPL is increased. Therefore, in the exemplary embodiment of the present invention, the data voltages supplied to the pixels of the display panel 10 may be adjusted by adjusting the gamma reference voltages GMAs. Accordingly, in the present invention, the light emission quantity of the organic light emitting diode (OLED) element of the pixels may be adjusted, and thus the peak luminance of the display panel may be controlled.

Further, in the present invention, the weighted average picture level may be shifted to a higher value region as compared to a comparative example where the peak luminance of the display panel is controlled to be low according to the average picture level. Accordingly, the peak luminance of the display panel may be low. Accordingly, in the present invention, power consumption may be further reduced as compared to the comparative example.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display comprising:

a display panel including data lines, gate lines, and pixels disposed in a matrix form in a crossing region of the data lines and the gate lines;

a gamma reference voltage adjustment unit calculating a weighted average picture level of digital video data, adjusting gamma reference voltages so that peak luminance of the display panel is reduced as the weighted average picture level is increased, and outputting the adjusted gamma reference voltages;

a data driving circuit converting the digital video data into analogue data voltages by using the gamma reference voltages, and supplying the data voltages to the data lines; and a gate driving circuit sequentially outputting gate pulses to the gate lines, wherein the gamma reference voltage adjustment unit includes:

a grayscale representative value calculator calculating a maximum value of red, green, and blue data of pixel data as a grayscale representative value of the pixel data; and a weighted average picture level calculator calculating a sum of values obtained by dividing a square of the grayscale representative value by a peak white grayscale as a first value, calculating a sum of values obtained by dividing the grayscale representative value by the peak white grayscale as a second value, and calculating a value obtained by dividing the first value by the second value as the weighted average picture level.

2. The organic light emitting diode display of claim 1, wherein the gamma reference voltage adjustment unit further includes:

a gamma reference voltage adjustment data output unit including a look-up table storing gamma reference voltage adjustment data including high potential voltage data and tap voltage data, and outputting the gamma reference voltage adjustment data stored in the look-up table according to the weighted average picture level; and a gamma reference voltage output circuit differently outputting the gamma reference voltages according to the gamma reference voltage adjustment data by adjusting a high potential voltage and tap voltages according to the gamma reference voltage adjustment data.

3. The organic light emitting diode display of claim 2, wherein the gamma reference voltage adjustment data are data adjusting the gamma reference voltages so that the gamma reference voltages are reduced as the weighted average picture level is increased.

4. The organic light emitting diode display of claim 3, wherein the gamma reference voltage output circuit includes:

a digital analogue converter converting the high potential voltage data and the tap voltage data of the gamma reference voltage adjustment data into the high potential voltage and the tap voltages and outputting the high potential voltage and the tap voltages; and a voltage divider circuit dividing the high potential voltage, the tap voltages, and a low potential voltage and outputting the gamma reference voltages.

5. The organic light emitting diode display of claim 1, wherein the data driving circuit includes the voltage divider circuit dividing the gamma reference voltages and outputting gamma compensation voltages, and converts the digital video data into the data voltages by using the gamma compensation voltages.

6. A method for driving an organic light emitting diode display including a display panel having data lines, gate lines, and pixels disposed in a matrix form in a crossing region of the data lines and the gate lines, comprising:

calculating a weighted average picture level of digital video data, adjusting gamma reference voltages so that peak luminance of the display panel is reduced as the weighted average picture level is increased, and outputting the gamma reference voltages;

converting the digital video data into analogue data voltages by using the gamma reference voltages, and supplying the data voltages to the data lines; and sequentially outputting gate pulses to the gate lines, wherein the calculating of the weighted average picture level of the digital video data, the adjusting of the gamma reference voltages so that the peak luminance of the display panel is reduced as the weighted average picture level is increased, and the outputting of the gamma reference voltages includes:

calculating a maximum value of red, green, and blue data of pixel data as a grayscale representative value of the pixel data; and calculating a sum of values obtained by dividing a square of the grayscale representative value by a peak white grayscale as a first value, calculating a sum of values obtained by dividing the grayscale representative value by the peak white grayscale as a second value, and calculating a value obtained by dividing the first value by the second value as the weighted average picture level.

7. The method of claim 6, wherein the calculating of the weighted average picture level of the digital video data, the adjusting of the gamma reference voltages so that the peak luminance of the display panel is reduced as the weighted average picture level is increased, and the outputting of the gamma reference voltages further includes:

outputting gamma reference voltage adjustment data stored in a look-up table according to the weighted average picture level; and differently outputting the gamma reference voltages according to the gamma reference voltage adjustment data by adjusting a high potential voltage and tap voltages according to the gamma reference voltage adjustment data.

8. The method of claim 7, wherein the gamma reference voltage adjustment data are data adjusting the gamma reference voltages so that the gamma reference voltages are reduced as the weighted average picture level is increased.

9. The method of claim 7, wherein the differently outputting of the gamma reference voltages according to the gamma reference voltage adjustment data includes:

converting high potential voltage data and tap voltage data of the gamma reference voltage adjustment data into the high potential voltage and the tap voltages, and outputting the high potential voltage and the tap voltages; and dividing the high potential voltage, the tap voltages, and a low potential voltage, and outputting the gamma reference voltages.

10. The method of claim 6, wherein in the converting of the digital video data into the analogue data voltages by using the gamma reference voltages, and the supplying of the data voltages to the data lines, the gamma reference voltages are divided by using a voltage divided circuit, gamma compensation voltages are outputted, and the digital video data are converted into the data voltages by using the gamma compensation voltages.

* * * * *